US005228578A

United States Patent [19]

Wu

[11] Patent Number: 5,228,578

[45] Date of Patent: Jul. 20, 1993

[54] ADJUSTABLE BOOK SHELF

[76] Inventor: Shu-Chen Wu, 7th Floor, No. 7, Lane 391, Chuang Chin Road, Taipei, Taiwan

[21] Appl. No.: 871,060

[22] Filed: Apr. 20, 1992

[51] Int. Cl.[5] ..... A47B 65/00

[52] U.S. Cl. ..... 211/43; 211/175; 211/184

[58] Field of Search ..... 211/43, 175, 184, 189, 211/201, 105.3

[56] References Cited

U.S. PATENT DOCUMENTS

| | | | |
|---|---|---|---|
| 945,877 | 1/1910 | Updegraff | 211/43 |
| 1,266,776 | 5/1918 | Dietzel | 211/43 X |
| 2,504,466 | 4/1950 | Stolzoff | 211/43 X |
| 2,620,929 | 12/1952 | Sportsman | 211/43 X |
| 3,850,303 | 11/1974 | Franklin | 211/43 X |

*Primary Examiner*—J. Franklin Foss

*Attorney, Agent, or Firm*—Bacon & Thomas

[57] ABSTRACT

An adjustable book shelf is equipped with a plurality of telescopic rod members adjustably disposed between a pair of side boards and a couple of length variable support sticks which are attached in parallel with the rod members to the side boards. A plurality of spring biased limiting arms are pivotably mounted to one of the rod members and are located contiguously side by side. Each limiting arm is spring biased and can be pivoted when pushed by an inserted book or books so that the same can be held in place by the next neighboring limiting arms which are in abutmenmt with the books, and when the book or books is taken away the pivoted limiting arm or arms will resume the original position. The number of limiting arms pivotably pushed away by the inserted book or books is approximately dependent of the thickness of the same.

6 Claims, 7 Drawing Sheets

ADJUSTABLE BOOK SHELF

BACKGROUND OF THE INVENTION

1. Field of the Invention

The present invention is related to an adjustable book shelf which is provided with a plurality of contiguous limiting arms disposed side by side with each other and pivotably mounted to one of a number of telescopic rod members which are removably and adjustably secured between a pair of side boards; and each limiting arm is spring biased and can be pushed to pivot away by an inserted book or books which can then be held in position by the other neighboring limiting arms of the book shelf. A number of spare limiting arms are available so that when the telescopic rod members are extended the same can be attached thereto in addition.

2. Description of the Prior Art

Referring to FIG. 1, the first type book shelf of the prior art is made up of a pair of L shaped side holding hands 1A which are free to move by a person so that the number of books disposed therebetween can be theorically unlimited as long as the side holding hands 1A are able to be located freely on a horizontal plane. However, this type of book shelf has no fixed structure so that the side holding hands are easily pushed aside with the books therebetween collapsed; besides, it is relatively inconvenient in practical use, for instance, if one book is taken away from the shelf, the other books have to be relocated with the side holding hands 1A pushed inwardly toward the center to support the other books in place.

As shown in FIG. 2, the other kind of prior art book shelf is commonly seen and used. This book shelf is characterized in that it is additionally equipped with a slidable U shaped limiting element 32A which is slidably mounted on a pair of grooved tracks 31A defined on the supporting stick 3A of the book shelf. The book shelf has a pair of side boards 2A which are fixedly secured in place and books are held by the slidable limiting element 32A. This type of book shelf is comparatively convenient to operate, but can still be improved in the structure thereof so as to accommodate more books with the books secured more readily in place without manually actuating the sliable holding element 32A.

To make an improvement on the prior book shelves, the present inventor has worked out a new adjustable book shelf which is equipped with a length variable structure and a plurality of pivotably operated and spring biased limiting arms which are contiguously disposed side by side so as to permit the inserted books instantly held in place without making any adjustment on the book shelf or books.

SUMMARY OF THE INVENTION

The primary object of the present invention is to provide an adjustable book shelf which is equipped with a plurality of contiguous limiting arms which are spring biased and pivotably actuated so that the inserted books can be instantly tightly held in place thereby and can also be separatedly sorted, if desired, by the limiting arm or arms serving as a divider.

Another object of the present invention is to provide an adjustable book shelf which is equipped with a number of telescopic rod members disposed between a pair of side boards so that the length of the book shelf can be adjusted to accommodate more books therebetween.

BRIEF DESCRIPTION OF THE DRAWINGS

To make the structure and operational modes and features of the present invention better understood by people of the general skill in this field, a number of drawings are illustrated in company with a detailed description of the preferred embodiment, in which.

.

DETAILED DESCRIPTION OF THE PREFERRED EMBODIMENT

Figure 1:
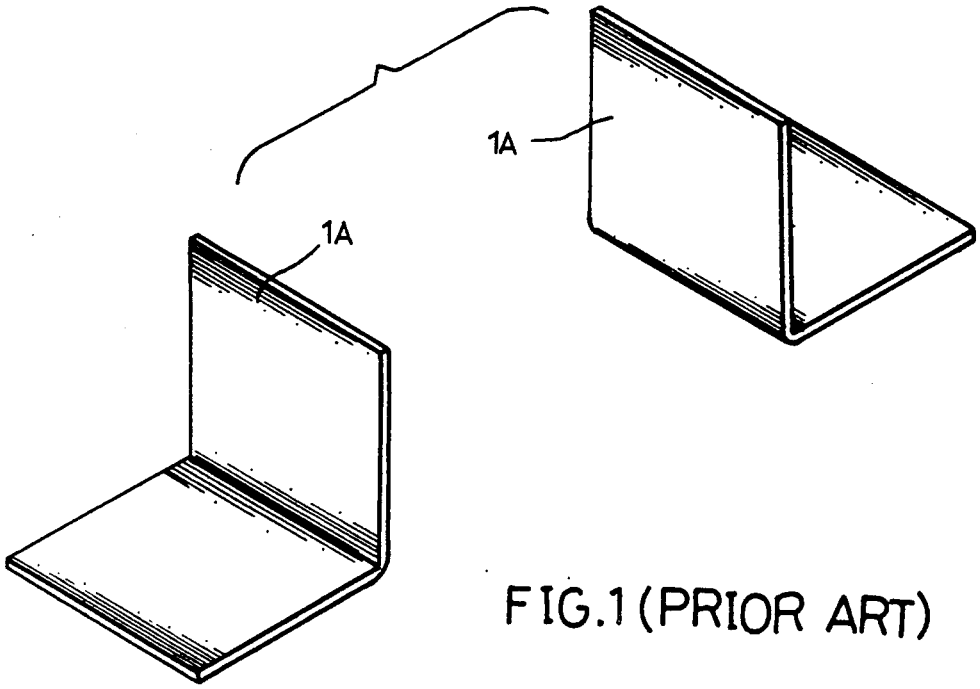
FIG.1 (PRIOR ART)
FIG. 1 is a diagram showing a first prior art book shelf.
Figure 2:
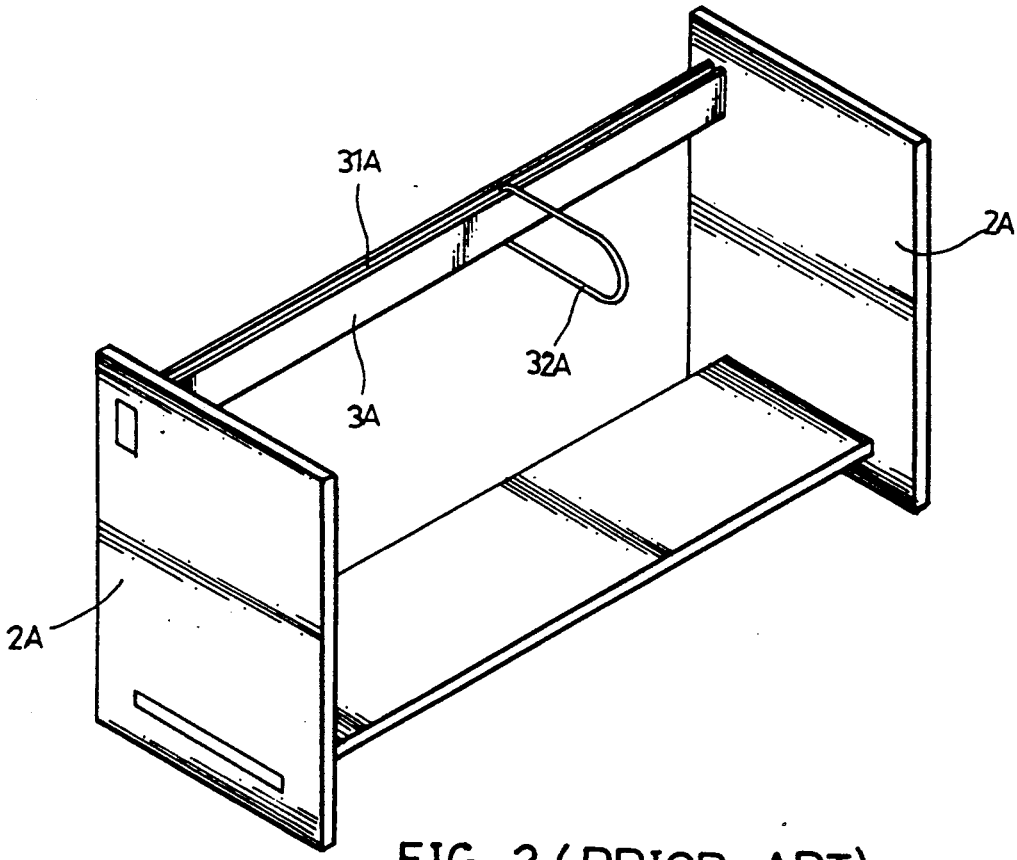
FIG. 2 (PRIOR ART)
FIG. 2 is a diagram showing a second prior art book shelf.
Figures 3, 3A:
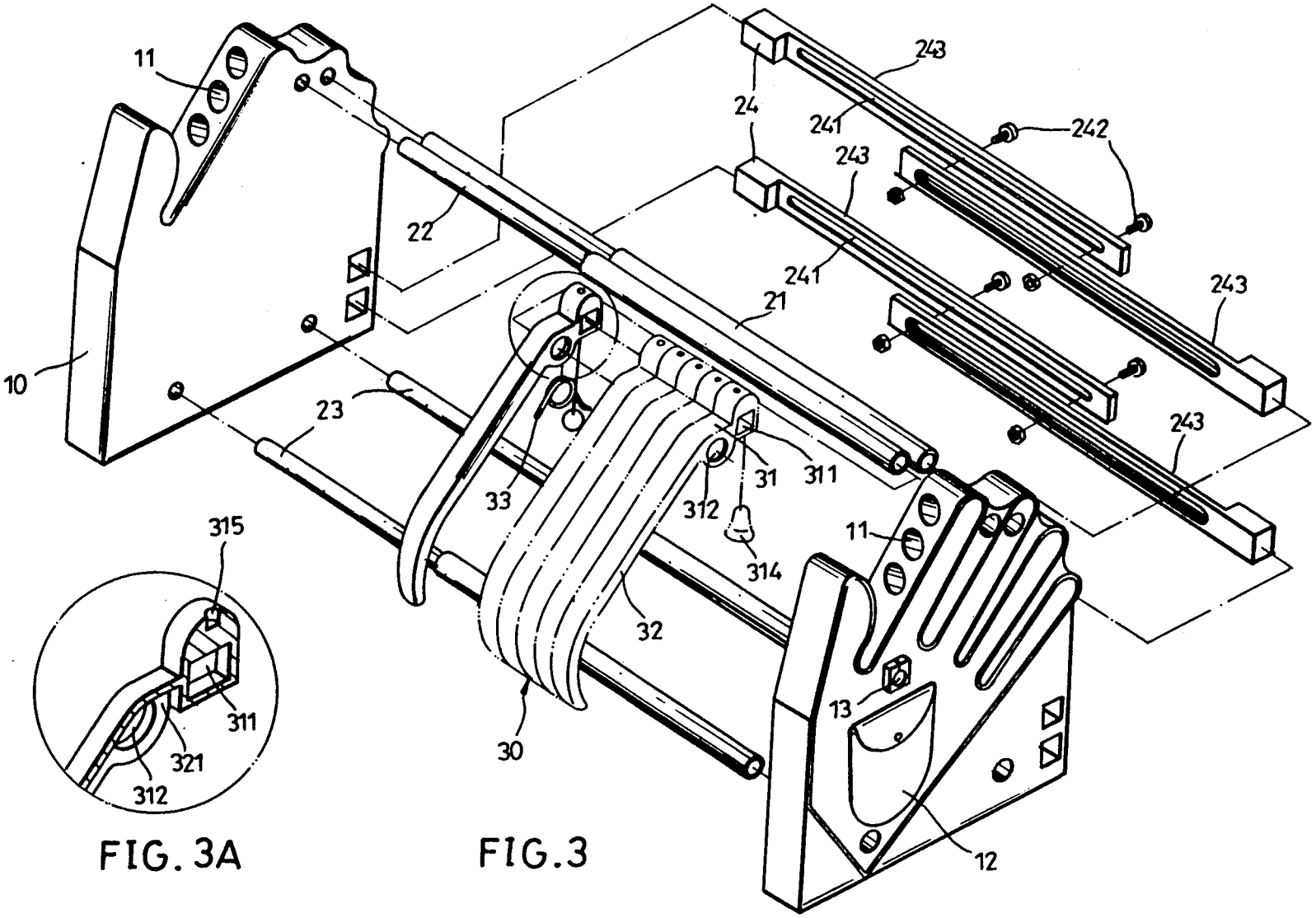
FIG. 3 is a perspective view of the exploded components of the present book shelf.
FIG.3*a* is a cross-section of the upper end of a limiting arm.
Figure 4:
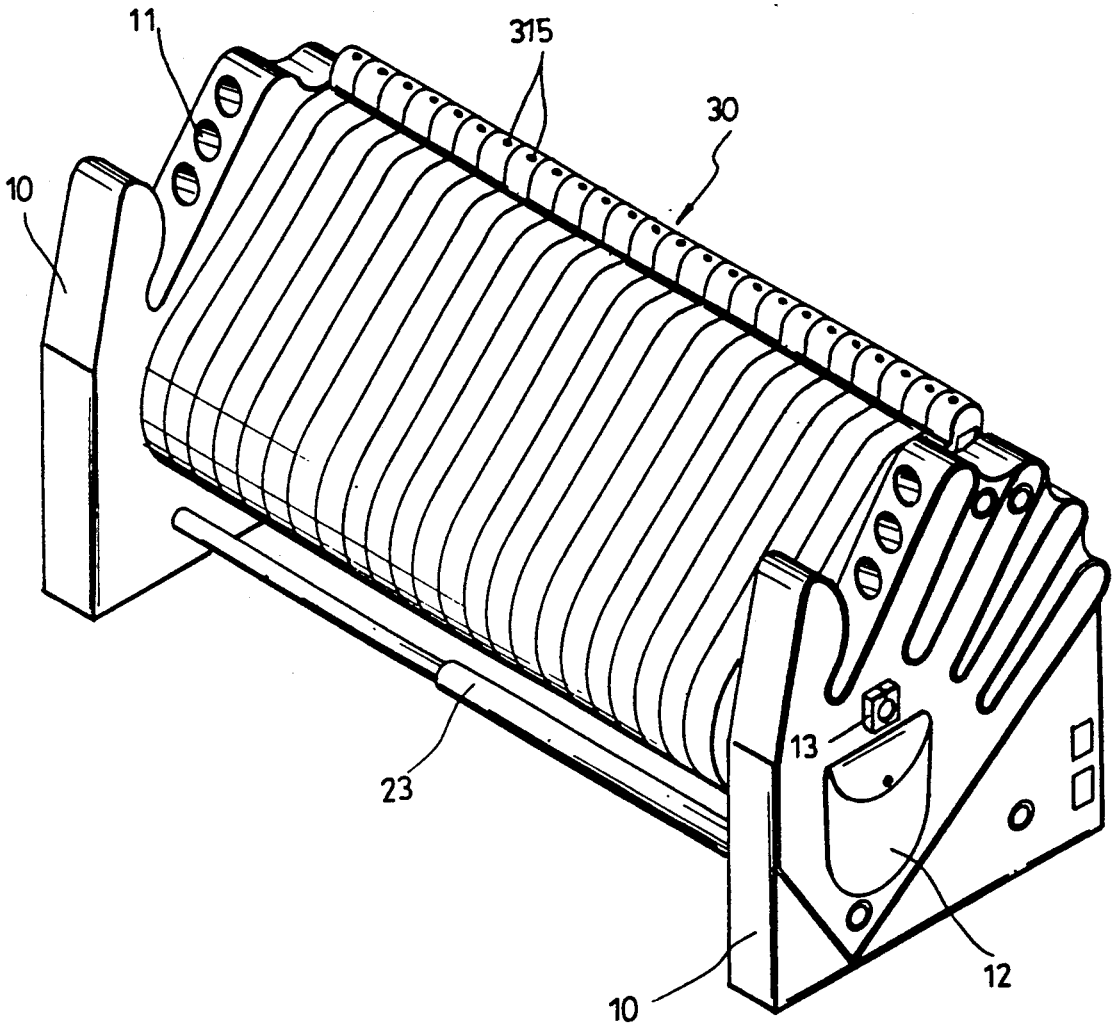
FIG. 4 is a perspective view of the well established book shelf of the present invention.
Figure 5:
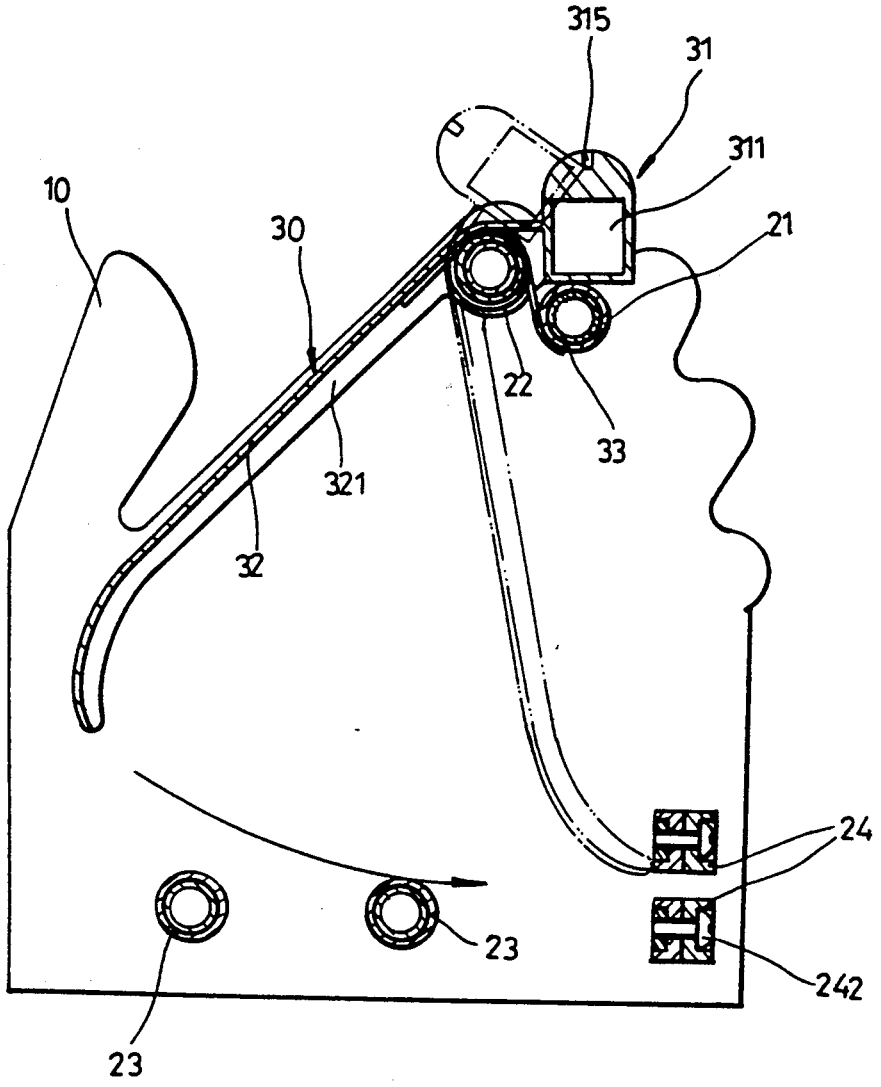
FIG. 5 is a diagram showing the operation mode of the pivotal and spring biased limiting arms.

Referring to FIGS. 3,4,5, the present adjustable book shelf is comprised of a pair of side boards 10, a first adjustable telescopic rod member 21, a second telescopic rod member 22, and a pair of third telescopic rod members 23 and a pair of length variable support sticks 24 and a plurality of spring biased pivotable limiting arms 30. Each side board 10 is provided with a number of insertion holes 11 on the upper edge thereof for the location of pens, pencils or the like therein, and a pocket member 12 is disposed on the outer face thereof for receiving small pieces of articles such as paper clips, rulers, or knifes therein. A small size pencil sharpener 13 is attached to the side board 10 and can be removed for cleaning of the debris of the sharpened pencils.

Between the side boards are located the telescopic rod members 21,22,23 and the length variable support sticks 24, each end of the rod members and support sticks is secured to the side boards 10 respectively so that the book shelf can be extended or shortened to vary the volume of accommodation thereof by simple adjustment of the length of the telescopic rod members and the support sticks.

The first and second telescopic rod members 21 and 22 are disposed near the top of the side boards 10 and a plurality of spring biased limiting arms 30 are pivotably members 21,22,23. The attachment of the spare limiting arms is easily effected by simply detaching one end of the second telescopic rod member 22 from one of the side boards 10 and engaging the round hold 312 of each limiting arm 30 with the second telescopic rod member 22 thereby the same can be contiguously located side by side therealong, and the detached end of the second telescopic rod member 22 is relocated onto the side board 10 to complete the task.

The first and second telescopic rod members 21, 22 are disposed in parallel with and adjacent to each other at the top and the back of the present book shelf in such a manner that the head portion 31 of the limiting arm 30 can lean against the first telescopic rod member 21. The third telescopic rod members 23 are disposed at the bottom of the book shelf to support the books located thereon. Under the first and second telescopic rod members 21,22 and near the bottom of the book shelf are disposed the paired length variable support sticks 24 each of which is comprised of a pair of stick unit 243. Each of the stick unit is provided with an elongated slot 241 and is adjustably engaged with another stick unit by a couple of screws 242 which are loosened to permit the support stick 24 to extend and tightened to fix the length thereof.

Figure 6:
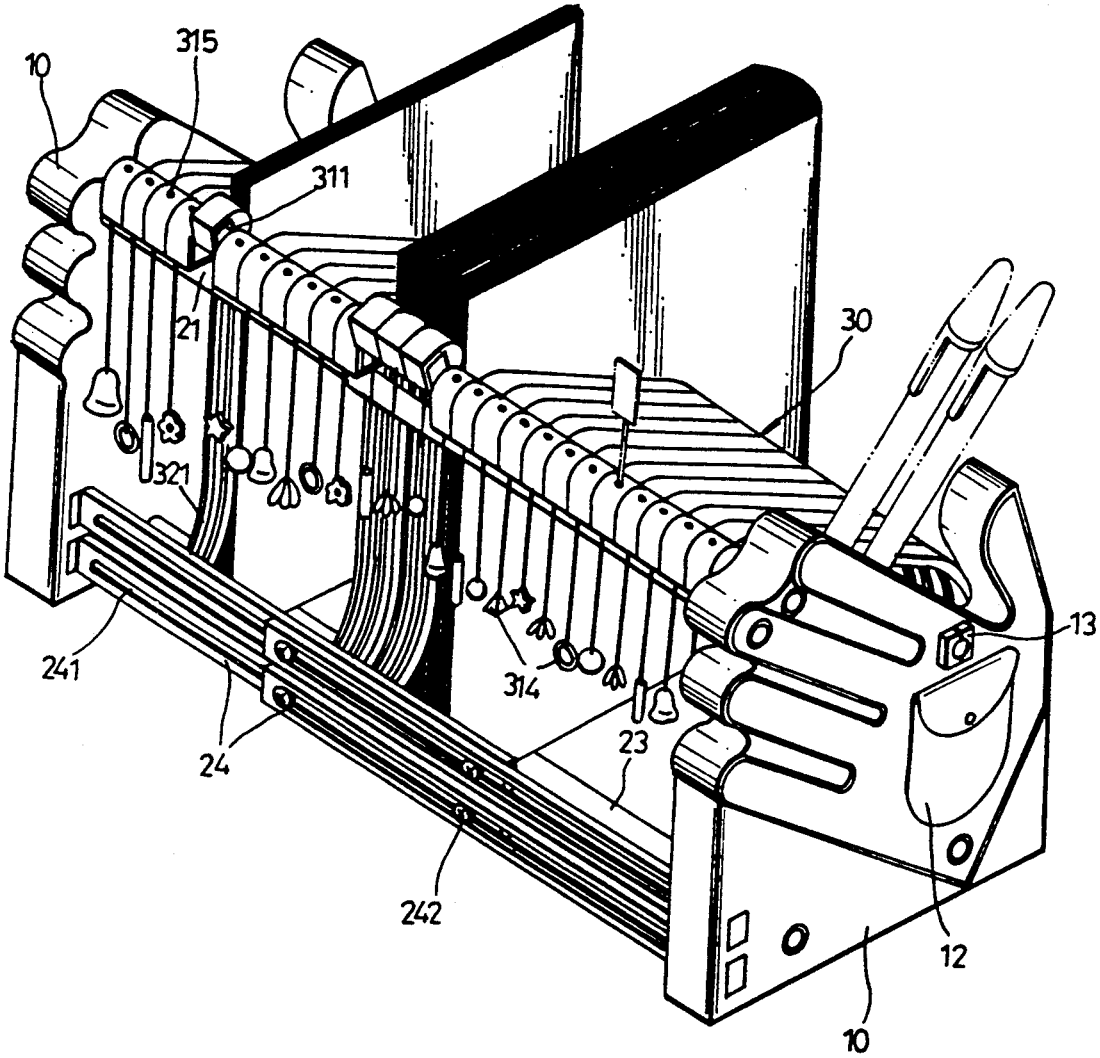
FIG. 6 is a diagram showing the practical use of the book shelf with books held by the limiting arms.

Referring to FIGS. 4, 6, it is clearly illustrated that when a book or books is pushed against the pivotal limiting arm or arms, the number of the limiting arms 30 pivoted away depending upon the thickness of the inserted book or books. However, the inserted book or books can always be held firmly in place by the contiguous limiting arms 30 so that the same will not collapse on the book shelf of the present invention. When the inserted books are taken away, the actuated limiting arms 30 will resume their positions by way of the spring elements 33. The limiting arms 30 can also serve to separate sorted books apart as a divider.

Figure 7:
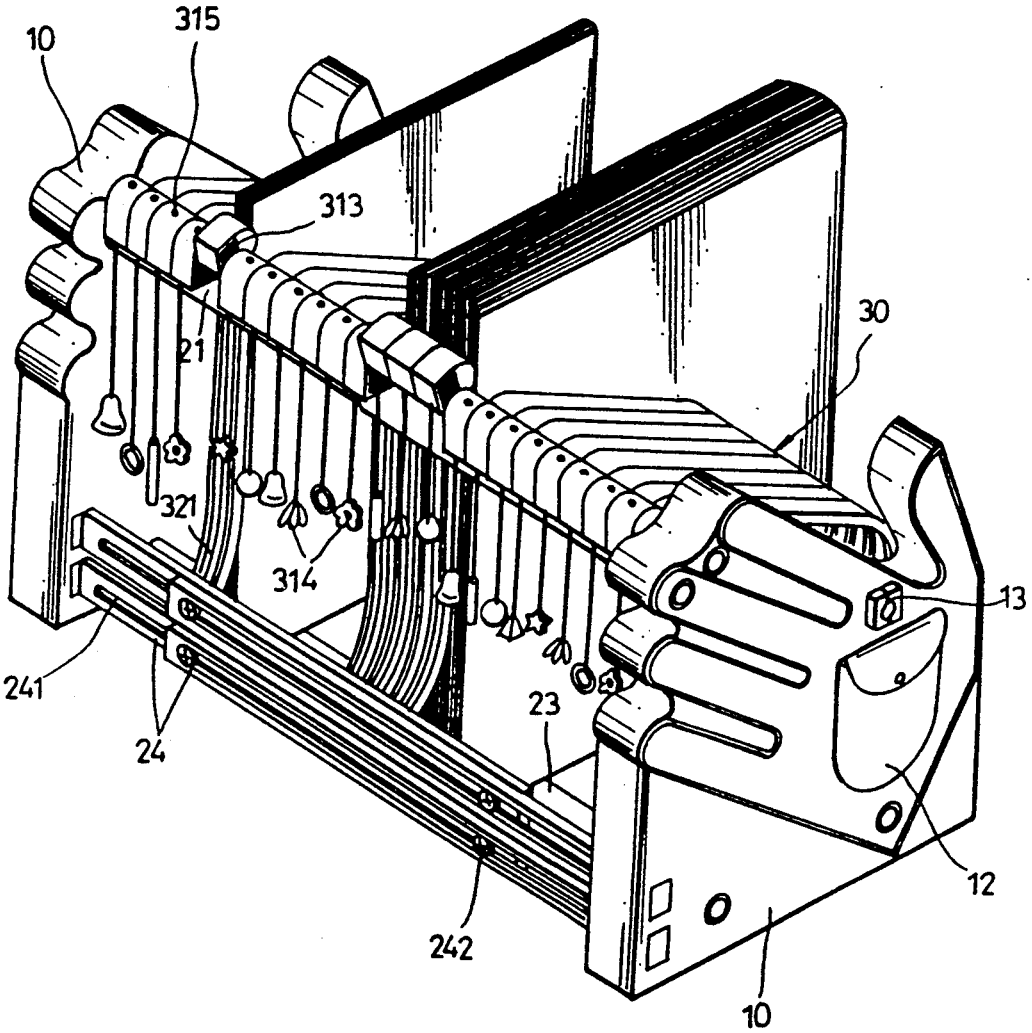
FIG. 7 is a diagram showing the book shelf being shortened and each limiting being provided with a counterweight.
Figure 8:
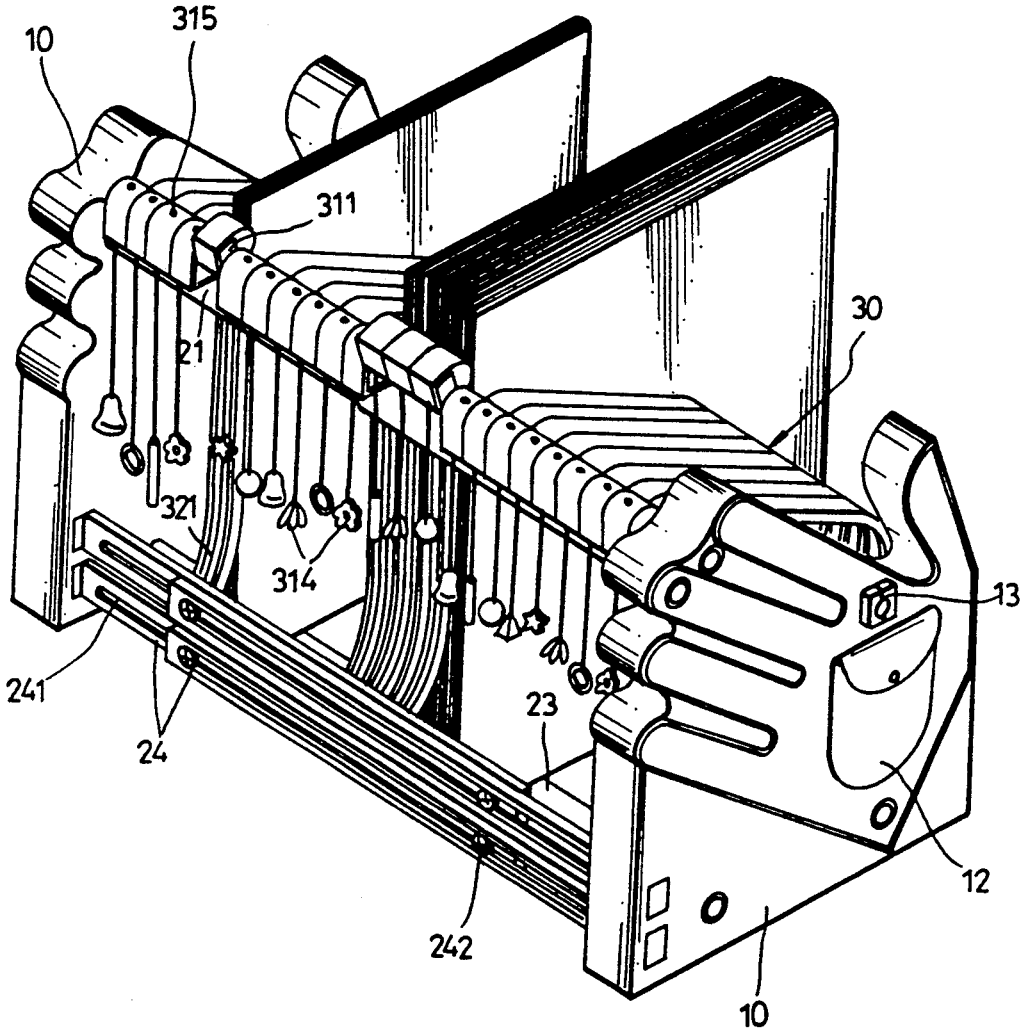
FIG. 8 is a diagram showing the limiting arms without the use of a counterweight but the equipment of a string of a decoration article to each limiting arm which is of the same function as a counterweight.

Referring to FIG. 7, the square hole 311 of each limiting arm 30 is provided with a counterweight 313 so that even when the spring element 33 is not resilient enough to make the limiting arm 30 resume its position due to elastic fatigue, the counterweight 313 can then help the arm 30 normally work as designed. As further shown in FIG. 8, there is a string of decoration article hanging from the head portion 311 can also serve as a counterweight and help the limiting arm to resume its position when not actuated even if the spring element 33 is in elastic fatigue in one aspect, and can also be used as an appealing decoration article in other.

It will, of course, be understood that various details of construction may be modified through a wide range without departing from the principles of this invention, and it is, therefore, not the purpose to limit the patent granted hereon otherwise than as necessitated by the scope of the appended claim.

I claim:

1. An adjustable book shelf for receiving books, comprising:

a pair of side boards;

a first telescopic rod member having two ends removably associated with said side boards respectively;

a second telescopic rod member having two ends removably associated with said side boards respectively and disposed in parallel with and adjacent to said first telescopic rod member near the top and back of the book shelf;

a pair of third telescopic rod members disposed at the bottom of said book shelf for supporting books thereon;

a pair of length variable support sticks each having two stick units provided with an elongated slot respectively so that said two stick units can be adjustably associated with each other; the two ends of said support sticks being removably engaged with said side boards respectively;

a plurality of limiting arms contiguously disposed side by side along said second telescopic rod member in a pivotal manner; each said limiting arm having a head portion and an elongated arm portion; each head portion being provided with a square hole and a round hole disposed right next to each other and said second telescopic rod member being led through said round hole; each said elongated arm portion extended from said head portion being provided with a secured to the second telescopic rod member 22. Each limiting arm 30 has a head portion 31 having a square hole 311 disposed thereon with a round hole 312 located adjacent thereto for the passing of the second telescopic rod member 22; and an elongated arm portion 32 extended from the head portion 31; and a tiny hole 315 disposed on the top of the head portion 31 for the insertion of a sign post so as to facilitate the indication of the sorted books disposed on the shelf. The back of the elongated arm portion 32 is provided with a recessed cavity in form of the shape of the limiting arm 30, which is in communication with the round hole 312; and a spring element 33 is disposed in the recessed cavity and in alignment with the round hole 312, as shown in FIG. 5. As the limiting arm 30 is engaged with the second telescopic rod member 22 which is led through the round hole 312, the spring element 33 has two extended ends one of which is in abutment with the wall of the recessed cavity 321 and the other is disposed against the bottom of the first telescopic rod member 21, permitting the limiting arm 30 to be pivotably and retractably operated so that the limiting arm 30 can be pivoted away by an inserted book or books and resume its position when the books are removed. There are a plurality of spare limiting arms 30 available which can be attached to the second telescopic rod member 22 with ease when the book shelf is extended by lengthening the telescopic rod recessed cavity along the back thereof which is in communication with said round hole of said head portion;

and a spring element having two extended ends being disposed in said recessed cavity and in alignment with said round hole of said head portion with one extended end thereof in abutment with the wall of said recessed cavity of said elongated arm portion and the other end leaning against the bottom of said first telescopic rod member so that said limiting arm can be pivotably operated against said second telescopic rod member;

said limiting arm being pivotably associated with said second telescopic rod member with the head portion thereof leaning against the first telescopic rod member when said limiting arm is not actuated;

said head portion being provided with a tiny hole at the top thereof for the insertion of a sign post;

said first and second and third telescopic rod members and said length variable support sticks being adjustable along the length thereof with said limiting arms readily attached to said second telescopic rod member one by one to cover the full length of said second rod member so that said adjustable book shelf can be varied in size.

2. An adjustable book shelf as claimed in claim 1 wherein said square hole of said head portion of said limiting arm is provided with a counterweight so as to help said limiting arm resume its original position when not actuated.

3. An adjustable book shelf as claimed in claim 1 wherein each said limiting arm has attached thereto a decoration article hanging by a string from said head portion which can be used as a counterweight to help said limiting arm resume its position when not actuated.

4. An adjustable book shelf as claimed in claim 1 wherein each said side board is provided with a number of insertion holes on the upper edge thereof for the location of pens, or the like.

5. An adjustable book shelf as claimed in claim 1 wherein each said side board is provided with a pocket means on the outer face thereof.

6. An adjustable book shelf as claimed in claim 1 wherein each said side board is provided with a pencil sharpener on the outer face thereof.

* * * * *